US006286771B1

(12) United States Patent
Brown, Jr. et al.

(10) Patent No.: US 6,286,771 B1
(45) Date of Patent: Sep. 11, 2001

(54) TWO-STAGE MICRONIZER FOR REDUCING OVERSIZE PARTICLES

(76) Inventors: Charles Kepler Brown, Jr., 8317 Robert Bruce Dr., Richmond, VA (US) 23235; David Kepler Brown, 3327 Grove Ave., Apt. 6, Richmond, VA (US) 23221

( * ) Notice: Subject to any disclaimer, the term of this patent is extended or adjusted under 35 U.S.C. 154(b) by 0 days.

(21) Appl. No.: 09/302,359

(22) Filed: Apr. 30, 1999

Related U.S. Application Data

(60) Provisional application No. 60/097,813, filed on Aug. 25, 1998.

(51) Int. Cl.[7] ..... B02C 7/02

(52) U.S. Cl. ..... 241/162; 241/261.2; 241/261.3; 241/275; 241/296; 241/297

(58) Field of Search ..... 241/27, 29, 261.2, 241/261.3, 296, 297, 275, 162, 163

(56) References Cited

U.S. PATENT DOCUMENTS 1,624,037 4/1927 Butler .
2,585,881 * 2/1952 Walker ..... 241/168
3,411,724 * 11/1968 Noe ..... 241/188
4,355,586 * 10/1982 Brown ..... 110/229
4,691,867 * 9/1987 Iwako et al. ..... 241/21
5,275,631 * 1/1994 Brown et al. ..... 44/631
5,449,122 * 9/1995 Berger et al. ..... 241/261.2
5,575,824 * 11/1996 Brown et al. ..... 44/505
5,597,127 * 1/1997 Brown ..... 241/188.2
5,637,122 6/1997 Brown ..... 44/505
5,704,559 * 1/1998 Froberg et al. ..... 241/261.3

* cited by examiner

*Primary Examiner*—Allen Ostrager
*Assistant Examiner*—William Hong
(74) *Attorney, Agent, or Firm*—Jacobson, Price, Holman & Stern, PLLC

(57) ABSTRACT

Integrated first stage and second stage reduction mechanisms reduce coal, minerals, biomass, and other materials. A portion of the reductive work is done in the first stage by passing centrally fed feed material centrifugally from rotating rings to counter-rotating rings with destructive effects. The resulting material, significantly reduced in size, subsequently is stripped of oversize in the second stage by passing through a closely spaced and specially contoured final pair of annular rings or crushing elements between which particles larger than the limited space are crushed.

19 Claims, 19 Drawing Sheets

TWO-STAGE MICRONIZER FOR REDUCING OVERSIZE PARTICLES

CROSS-REFERENCE TO RELATED APPLICATIONS

The present patent application is based on, and claims priority from, U.S. provisional Application Ser. No. 60/097,813, filed Aug. 25, 1998, which is incorporated herein by reference in its entirety.

BACKGROUND OF THE INVENTION

1. Field of the Invention

The present invention relates to an apparatus and method for reducing the size of coal, minerals (including ores, compounds, and elements), biomass, waste, and other material. More specifically, the invention relates to a two-stage micronizing mill for reducing the size of such materials.

2. Related Art

Efficient size reduction technology through application of dual counter-rotating rotary mill design is undertaken in numerous patents. U.S. Pat. Nos. 5,275,631 and 5,575,824 to Brown et al. disclose combining such meanswith refuse separation means. U.S. Pat. No. 5,597,127 to Brown provides for finer milling. The present invention provides an improved method and apparatus for finer milling, and with particular regard to the problem of efficient reduction of oversize particles, provides for second stage selective milling integral to the mill itself, without classification and recirculation.

Classification and recirculation requires additional mechanical means which adds to capital costs. Operating costs increase also since typically discrimination is not precise and more material than necessary is returned for re-milling, including particles milled to within size specification as well as oversize particles.

The term "second-stage milling" refers to size-reduction by means of a separate type than that employed in the first stage. Here, primary milling is accomplished by attrition and impacting, while second stage reduction is accomplished by crushing, or—in the case of unfriable, fibrous materials—the crushing action results in pinching and rolling which separates fibers.

SUMMARY OF THE INVENTION

An object of this invention is to improve the size reduction technology for coal, minerals (including ores, compounds and elements), biomass, waste and other materials.

A further object of this invention is to provide more efficient and high rate means for pulverizing coal through initial milling means followed immediately by second stage milling means for reducing oversize, in order to supply a fineness grade of 99 percent smaller than 100 mesh and 80 percent smaller than 325 mesh, or similar grade also conducive to combustion with reduced nitrous oxides formation rates.

A still further object of this invention is to provide more efficient and high rate size reduction of various forms of biomass, such as wood chips, pecan shells or hybrid willow potentially useable as boiler fuel.

A further object of this invention is to provide autogenous wear resistance in milling structures.

Efficient high capacity size reduction of coal, minerals, biomass and other materials is accomplished through integrated first stage and second stage reduction means, in which a portion of the reductive work is done by passing centrally fed feed material centrifugally from rotating rings to counter-rotating rings with destructive effects, and the resulting material, significantly reduced in size, subsequently is stripped of oversize by passing through a closely spaced and specially contoured final pair of annular rings or crushing elements between which particles larger than the limited space are crushed.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
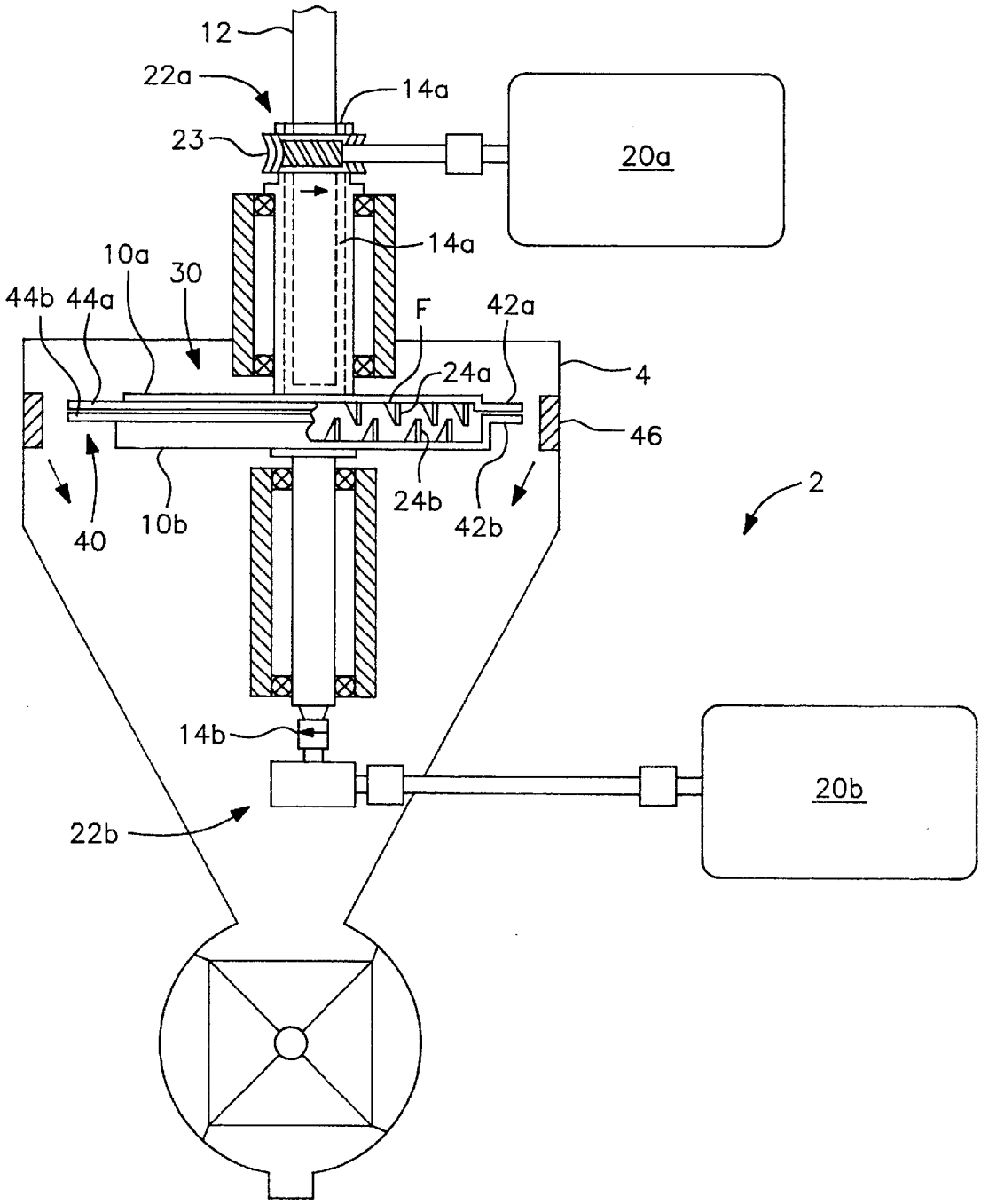
FIG. 1 is a diagrammatic view, partially in cross-section, of a general two-stage mill configuration in accordance with the present invention, wherein first stage reduction occurs within a system of annular, concentric, counter-rotating rings, and second stage reduction proceeds by crushing oversize particles between the outermost of the rings.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

FIG. 1 illustrates the-general two-stage configuration, FIGS. 2 through 6 illustrate alternative first stage configurations, and FIGS. 7 through 10 are alternative second stage configurations.

Referring now to FIG. 1, there is shown a general configuration of a two-stage micronizer unit 2 employed for integrated, two-stage micronizing in accordance with the present invention. The micronizer unit 2 includes a mill housing 4, co-axial upper (or first) and lower (or second) rotors 10*a* and 10*b* housed within the mill housing 4, and a center feed pipe 12 for passing material to the upper and lower rotors 10*a* and 10*b*. The upper rotor is carried on a rotatable, hollow, vertical, first shaft 14*a* that surrounds the central feed pipe 12. The first shaft 14*a* is rotated by a first motor 20*a*. The lower rotor is mounted on a vertical second shaft 14*b* substantially coaxial with the first shaft 14*a*, and is rotated by a second motor 20*b*.

Although the first and second shafts 14*a* and 14*b* are described and shown as being coaxial along a vertical axis, the present invention also contemplates a configuration wherein the first and second shafts 14*a* and 14*b* are coaxial along a horizontal axis or along a sloping axis. The upper and lower rotor would then be oriented side-by-side and the remaining components of the invention hereinafter described would be similarly re-oriented.

Separate upper and lower drive transmissions 22*a* and 22*b* provide counter-rotation of the rotors 10*a* and 10*b* with respect to each other. The upper and lower drive transmissions 22*a* and 22*b* can be any of various types, including right angle gears 23, or otherwise as discussed in more detail hereinafter.

The upper and lower rotors 10*a* and 10*b* comprise, respectively, a plurality of concentric rings 24*a* and 24*b*, with diameters of successive magnitudes, such that the rings 24*a* of the first rotor 10*a* interpose between the rings 24*b* of the second rotor 10*b*. All of the concentric rings 24*a* and 24*b* include a first stage or primary milling zone 30 of the general configuration.

In the primary milling zone 30, much of the size reduction work is performed as feed material F banks up centrifugally within each of the concentric rings 24*a* and 24*b*, at an angle repose of about 60°, and subsequent process material is thrown from ring to counter-rotating ring, colliding destructively with other process material or with resident reposed material. Added velocities of opposite rotations assist efficient particle size reduction, especially when ring configurations are improved as described below.

A second stage or secondary miffing zone 40 includes close-running, counter-rotating upper and lower rings 42*a* and 42*b* having respective facing surfaces 44*a* and 44*b*. These facing surfaces 44*a* and 44*b* can be planar and uninterrupted as shown in FIG. 1, or can have other configurations as described hereafter. Close-running clearance between the facing surfaces 44*a* and 44*b* permits on-size or under-size material to pass without further energy expenditure. However, oversize particles are broken down on these facing surfaces 44*a* and 44*b*, which are configured for that purpose, as described hereinafter. In addition, the oversize crushing surfaces move air through the entire mill, improving particle-to-particle turbulent destruction in the primary milling zone 30. A stationary annular impact ring 46 concentric with the upper and lower rings 24*a*, 24*b*, 42*a*, and 42*b* can be provided on the inner wall of the mill housing 4. The impact ring 46 provides further size reduction upon impact, and wear-resistant protection to the inner wall of the mill housing 4.

Preferably, the primary zone 30 includes three to five sets of annular rings 24*a* or 24*b* and the secondary zone 40 includes one or two sets of annular rings 42*a* or 42*b*.

Figure 2:
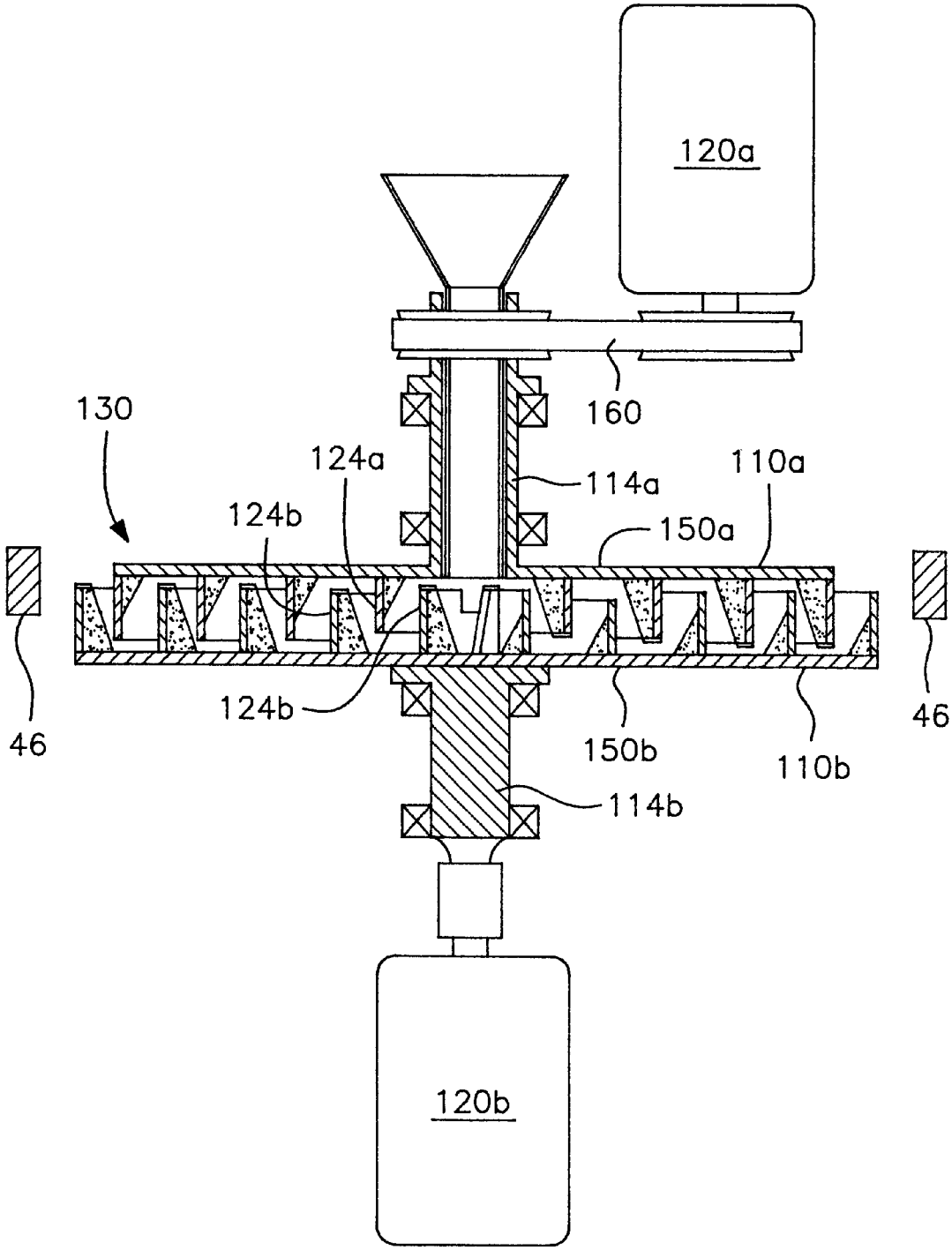
FIG. 2 is a cross-sectional view of a first embodiment of the configuration of the first stage counter-rotating rotors wit annular concentric ring modifications for resisting wear by retaining barriers of process material.
Figure 3:
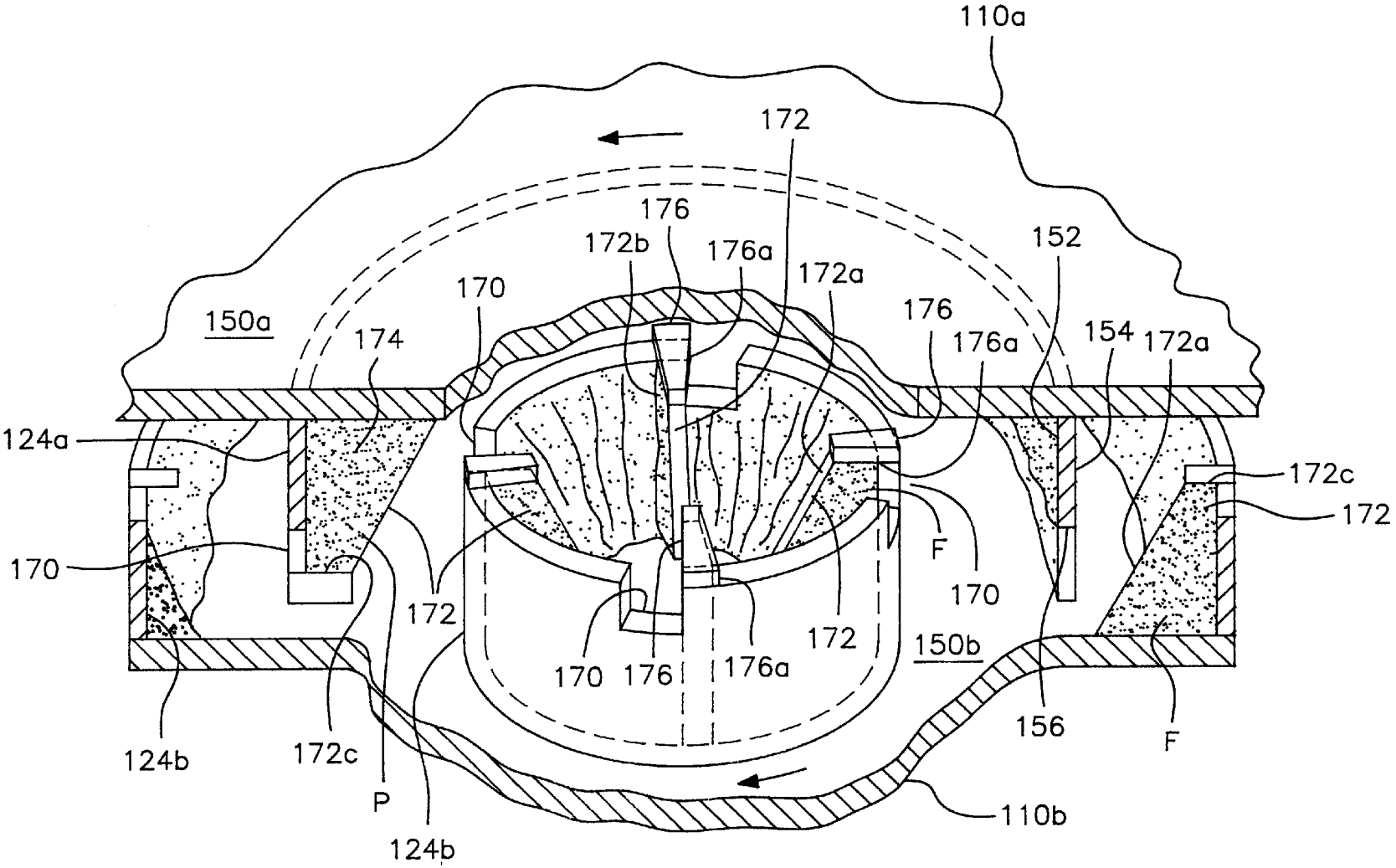
FIG. 3 is an enlarged perspective view, partially in cross-section, of the area designated by dashed lines in FIG. 2.

Referring now to FIGS. 2 and 3, there is shown a first embodiment of a first reduction stage 130 of a two-stage micronizer in accordance with the present invention. In the first embodiment, the upper and lower rotors 110*a* and 110*b* comprise, respectively, upper and plates 150*a* and 150*b* and a plurality of concentric rings 124*a* and 124*b* mounted respectively on the upper and lower plates 150*a* and 150*b*, with diameters of successive magnitudes, such that the rigs 124*a* of the first rotor 110*a* interpose between the rings 124*b* of the second rotor 110*b*. Each ring 124*a* or 124*b* has an inner peripheral wall 152 facing the rotor axis, an outer peripheral wall 154 facing away from the rotor axis, and an unmounted edge 156 joining the inner and outer peripheral walls 152 and 154 and facing away from its respective upper or lower plate 150*a* or 150*b*.

The first shaft 114*a* is rotated by a first motor 120*a*, by means of a belt drive 160. The second rotor 110*b* is mounted on a second shaft 114*b*, and is rotated by a second motor 120*b*, by means of direct drive. Direct drive is the most efficient of the drive transmission types as disclosed herein.

As best shown in FIG. 3, the rings 124*a* and 124*b* of the upper and lower rotors 110*a* and 110*b* are provided with cut-outs 170 spaced along their unmounted surfaces. The spacing of the cut-outs 170 is mass-balanced, that is, the cut-outs 170 are equidistant from each other, or if not equidistant, then spaced with respect to diametral lines in such a way that the mass of the rings 124*a* and 124*b* is balanced about their axis of rotation.

Preferably, the cut-outs are cut to a depth measured from the unmounted surfaces of the rings 124*a* and 124*b* of between about ⅜ inch to about 1 inch in rings 124*a* and 124*b* less than about 6 inches deep overall, or about ⅛to about ⅙ of overall ring depth in larger rings 124*a* and 124*b*.

vertical bars 172 are affixed to the rings 124*a* and 124*b* adjacent each of the cut-outs 170, to the trailing side of the cut-outs 170, which is downstream relative to the direction of rotor rotation, and at an angle relative to radial lines extending from the center of the rings 124*a* and 124*b*. In this embodiment, the rings 124*a* and 124*b* are near, but not abutting each of the cut-outs 170. Pockets 174 are defined at the conjunctions of the rings 124*a* and 124*b* and their respective bars 172 and the spaces between their respective bars 172 and the edge of each cut-out. The bars 172 retain process material in the pockets 174, for a purpose to be discussed hereinafter.

Each of the bars 172 has an interior face 172*a* facing the rotor axis, a pair of opposed side faces 172*b,* and an unmounted face 172*c* which extends from the unmounted edge of the ring. In this embodiment the unmounted faces 172*c* are perpendicular to the side faces 172*b*, while the interior faces 172*a* of the bars 172 are sloped, as shown in FIG. 3, in order to vary the proximity with the next ring on the opposed rotor by anal displacement.

In addition, horizontal caps 176 end inwardly from the unmounted edge 156 of the rings 124*a* and 124*b* over the unmounted faces 172*c* of the vertical bars 172 so as to crown the vertical bars 172. The horizontal caps 176 enhance retention of the process material and provide a protective barrier against wear to the vertical bars 172. The side faces 176*a* of the horizontal caps 176 are not parallel, but diverge from the interior to the exterior of the ring, to accord with the angular displacement of the bars 172 as described above. The angle at which the sides diverge can be selected according to the process material. Some materials will require deeper pockets 174 to retain protective resident process material.

Figure 4:
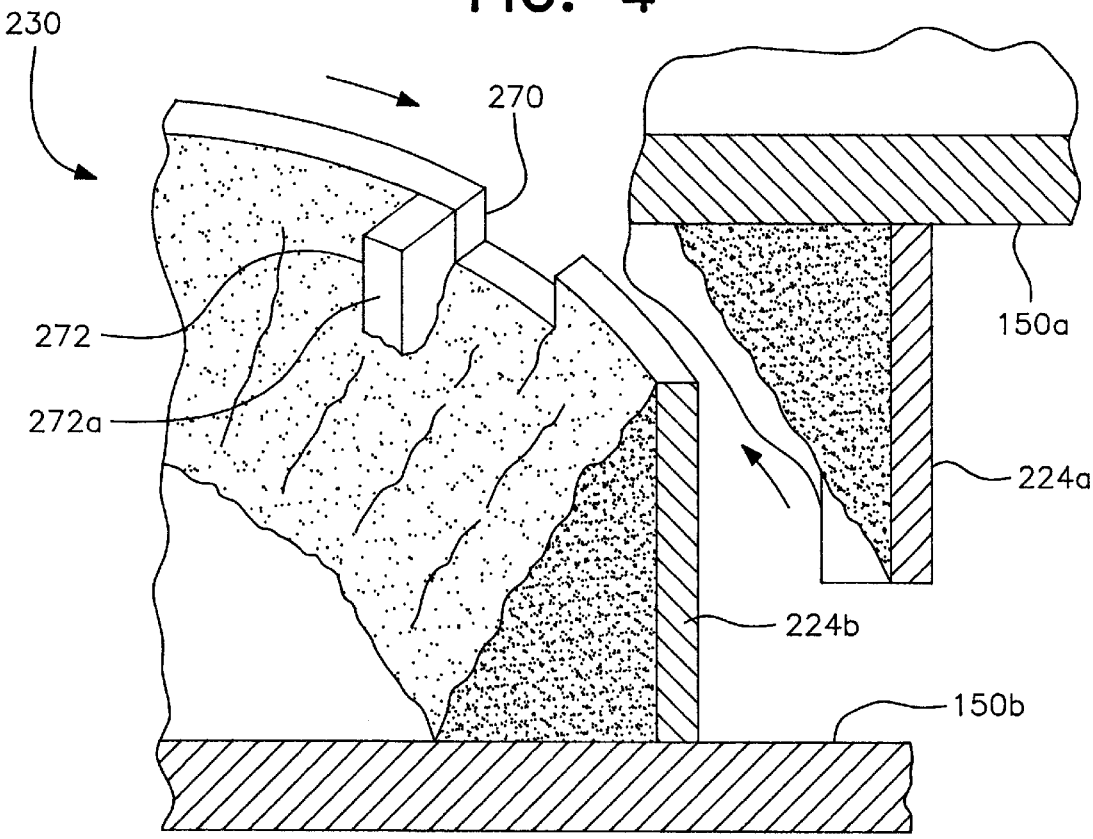
FIG. 4 is a partial perspective view, partially in cross-section, of a second embodiment of the first reduction stage rotor configuration including structural elements providing both shear and impact reduction.

In a second embodiment of the first reduction stage rotor 230, as shown in FIG. 4, the interior faces 272*a* of the bars 272 are perpendicular to the surface of the rotor 230, and the horizontal caps 176 are omitted. The primary zone ring configuration illustrated in FIG. 4 also places the bars 272 adjacent the cut-outs 270; however in this embodiment, the bars 272 abut the cut-outs 270. Improved shearing can be achieved by selecting radial clearances between the bars 272 of successive rings 224*a* and 224*b,* based on the process material particle sizes. Closer radial clearance between successive rings 224*a* and 224*b* promotes shearing of material, such as some forms of biomass, passing through the cut-outs 270 of any one ring and striking the bars 272 on the succeeding ring.

Retention of process material improves the wear resistance of the bars 272. The bars 272 can be sloped on their interior faces 272*a* (nearest the axis), as shown and described with reference to FIGS. 2 and 3, or they can be perpendicular to the surface of the rotor on their interior sides, as shown and described with reference to FIG. 4.

Figure 4A:
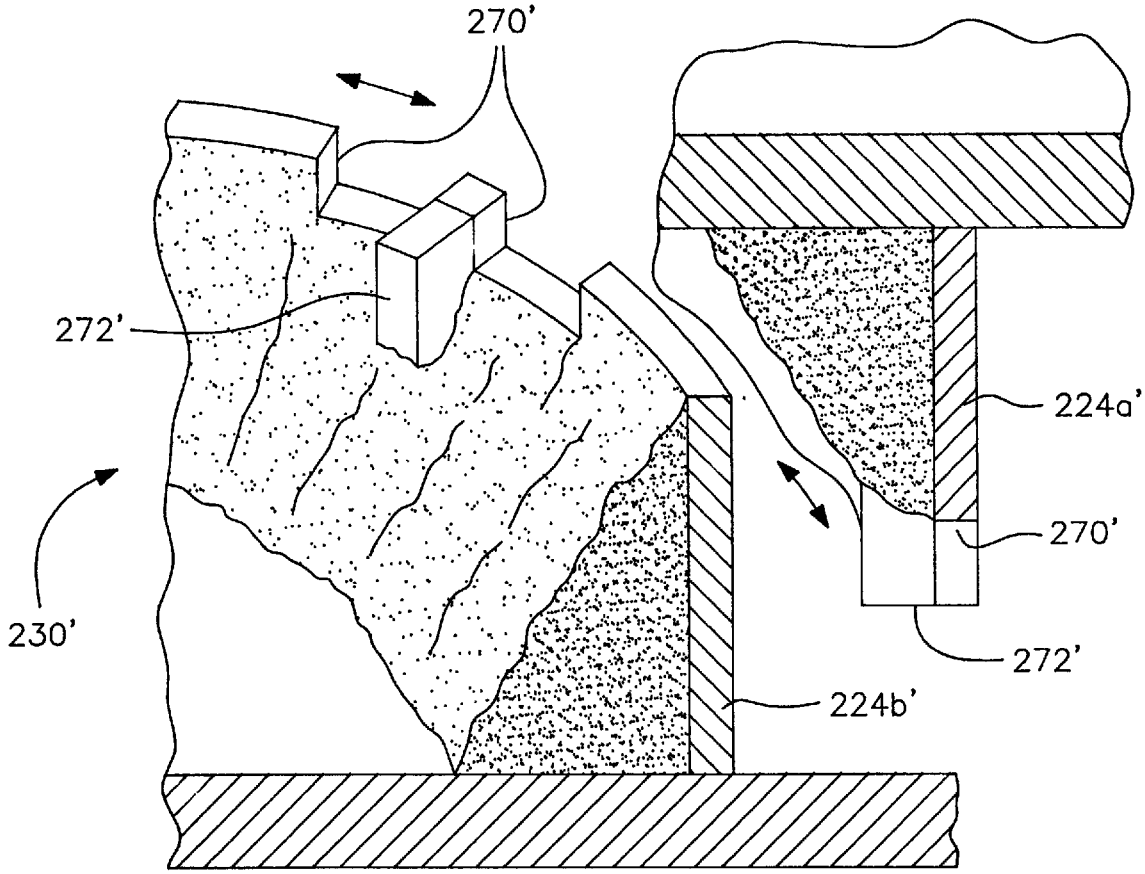
FIG. 4A is a partial perspective view, partly in cross-section, of a third embodiment of the first reduction stage rotor configuration, which is a variant of the second embodiment shown in FIG. 4.

FIG. 4A shows a third embodiment 230' of a first reduction stage rotor configuration, which is a variant of the second embodiment 230 shown in FIG. 4. The third embodiment 230' is identical to the second embodiment 230, except that pairs of cut-outs 270' are formed in the rings 224*a'* and 224*b'* abutting both sides of the bars 272'. The pairs of cut-outs 270' are placed on both sides of the bars 272' so that by switching the direction of rotation of the rings 224*a'* and 224*b'* (by switching the direction of their respective drive motors), new sources will be brought into service against which process material will impact when thrown from the preceding ring 224*a'* or 224*b'*. The process material is then re-accelerated to rim in the opposite direction and thrown through the cut-out 270' upstream of the bar 272'. The advantage of this embodiment is that, rather than losing machine service time for repairs to the worn surfaces, the motors can be reversed to present new surfaces.

Figure 5:
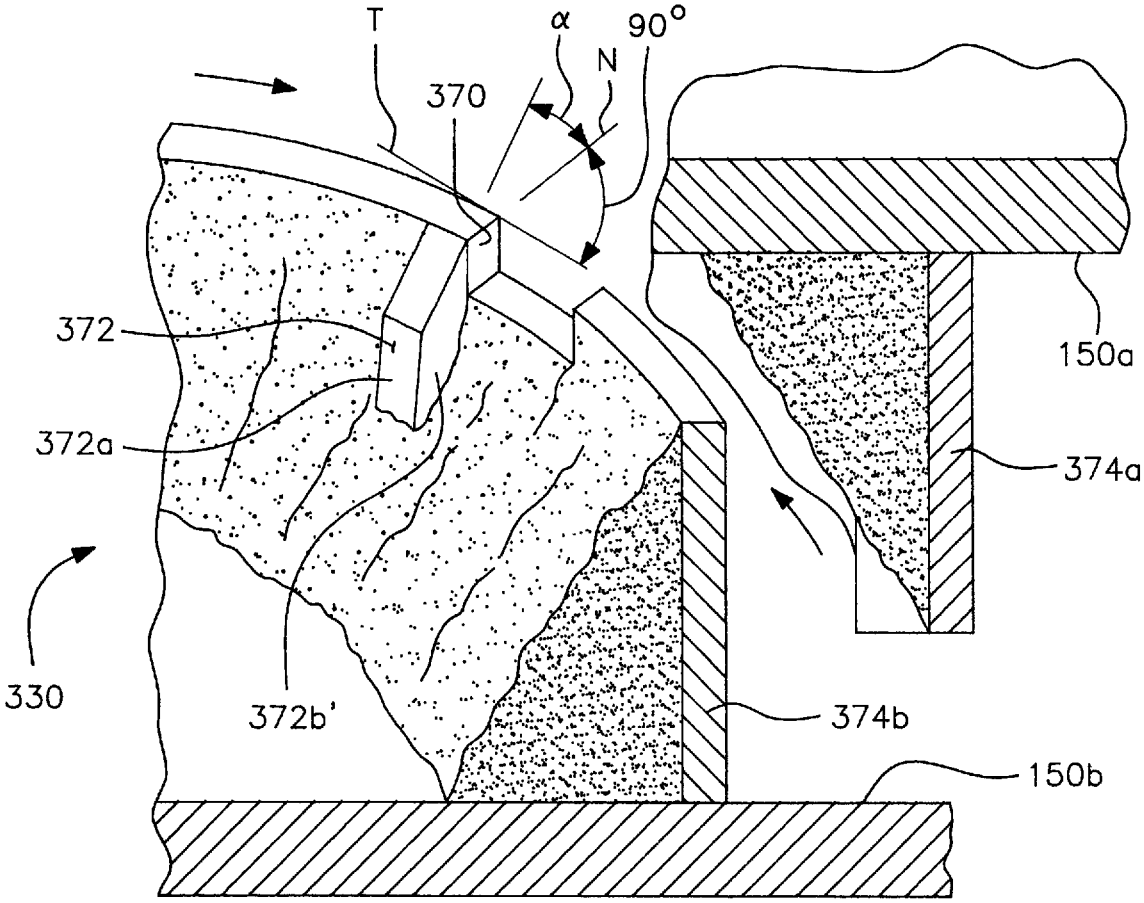
FIG. 5 is a partial perspective view, partially in cross-section, of a fourth embodiment of the first reduction stage rotor configuration, which is effective in reducing coal or coal combined with some forms of biomass.

FIG. 5 shows a fourth 330 of a first reduction stage rotor configuration, used in reducing coal or coal combined with some forms of biomass. When used for this purpose, the leading side face 372*b* $_1$ of the bar 372 forms an angle with a tangent T to the ring 374*a* or 374*b* (that is, the leading side face 372*b*$_1$, is positioned at an angle of about 3° to about 30° relative to a normal N to a tangent T at the trailing edge of the cut-out 370). Angling the leading side face improves the size distribution of the product, producing more superfine particles. This is believed to be due to increased air movement within the mill, promoting particle-to-particle impacts and improving size reduction by adding velocities to the process material. The interior faces 372*a* of the bars 372 are planar and beveled to make them approximately parallel to the tangent T.

Figure 6:
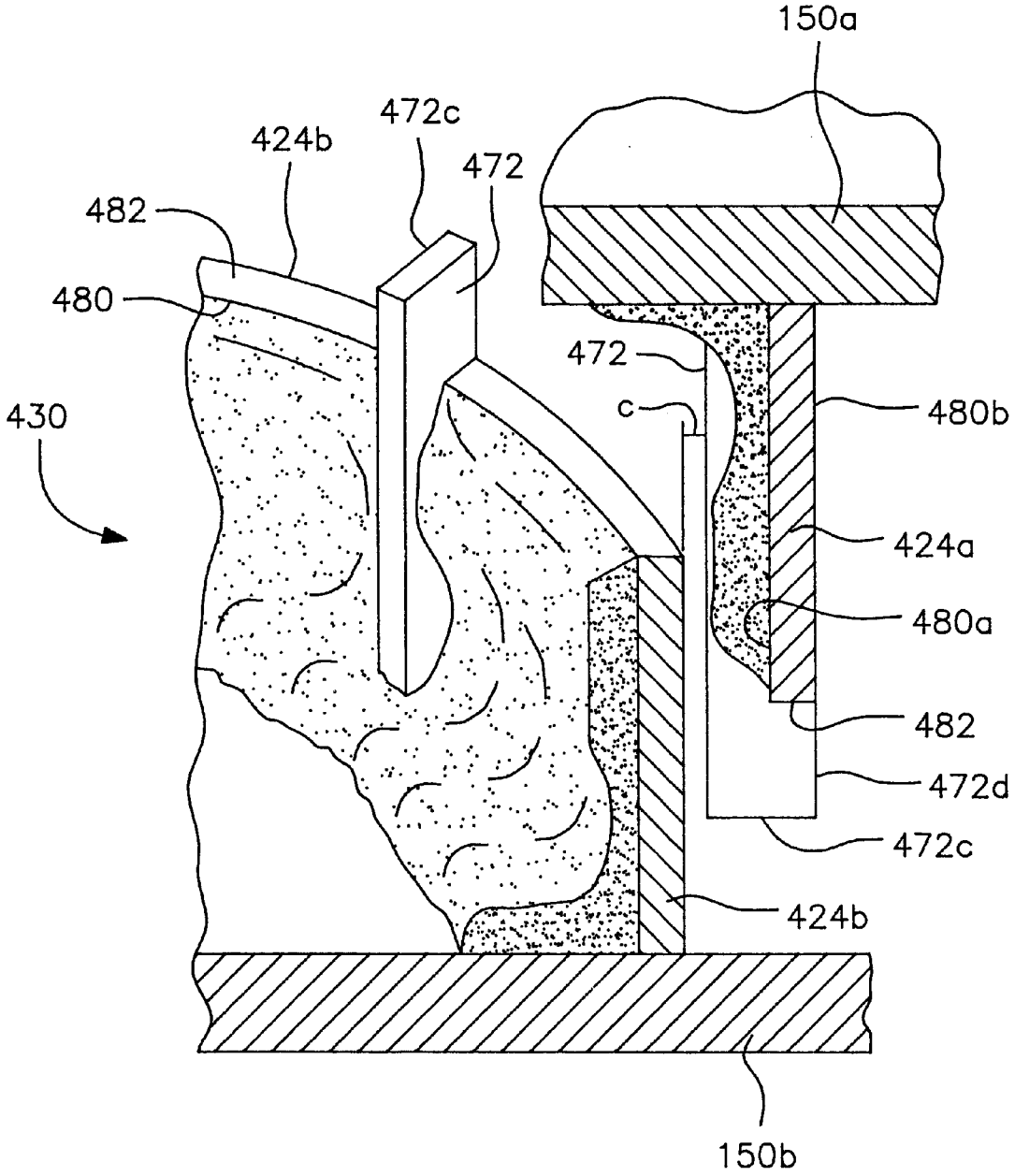
FIG. 6 is a partial perspective view, partially in cross-section, of a fifth embodiment of the first reduction stage rotor configuration including elements for shear and impact.

Referring now to FIG. 6, there is shown a fifth embodiment of the primary zone rotor ring 430. This embodiment is characterized by the omission of cut-outs. Instead of cut-outs, the rings 424*a* and 424*b* are provided with vertical bars 472 positioned at equidistant points around the inner peripheral walls 480*a* of the rings 424*a* and 424*b*. The bars 472 are higher than the rings 424*a* and 424*b,* so that the unmounted faces 472*c* of the bars 472 are offset from the unmounted edges 482 of the rings 424*a* and 424*b,* and in the portions which extend beyond the unmounted edges 482 of the rings 424*a* and 424*b,* the bars 472 have exterior faces that are even with the outer peripheral walls 480*b* of the rings 424*a* and 424*b*. Shearing action is promoted by providing a close clearance C between the bars 472.

Figure 7:
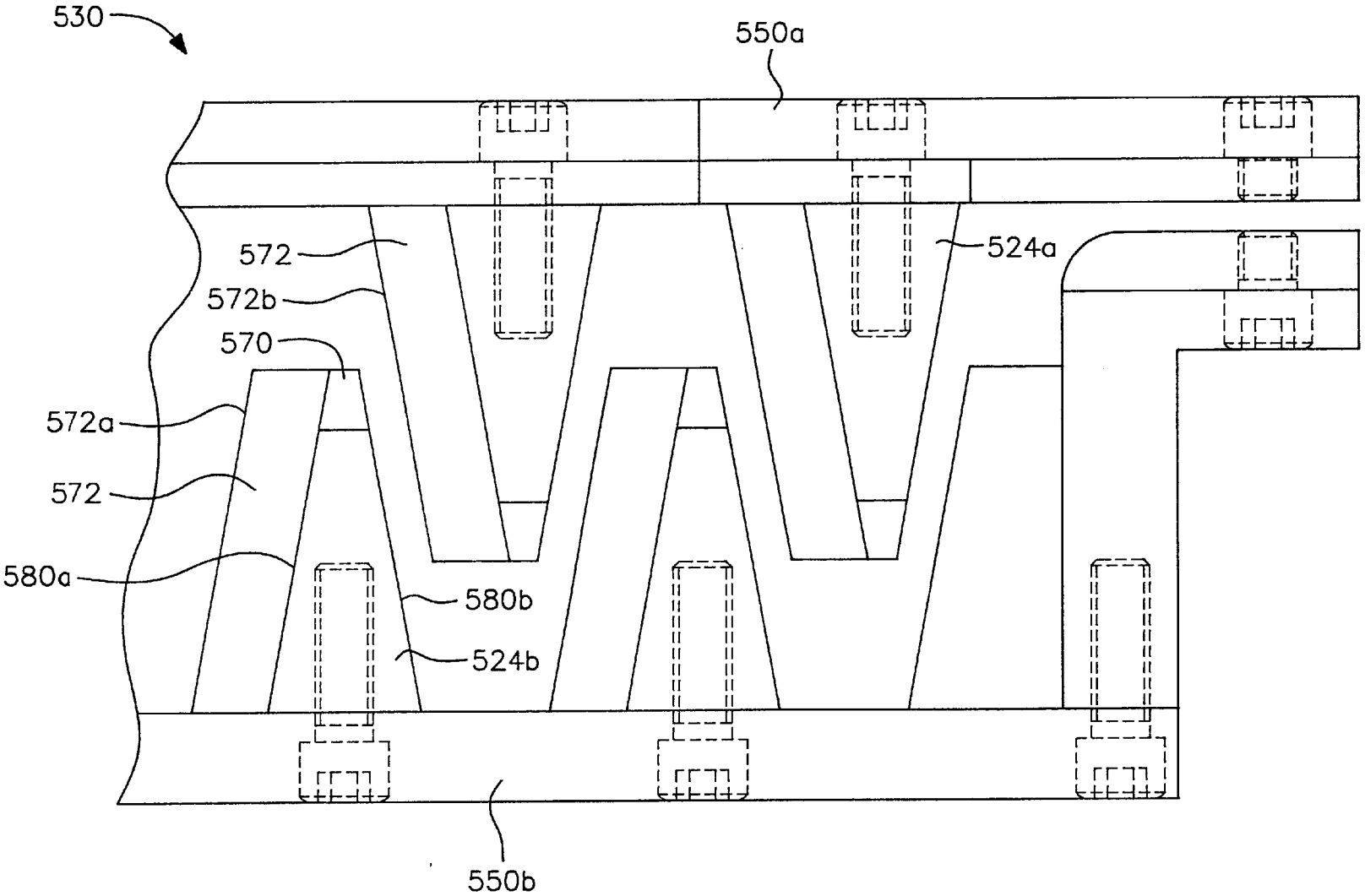
FIG. 7 is a cross-sectional view of a sixth embodiment of the first-stage rotor ring configuration useful in varying shear clearance between rotors.

FIG. 7 illustrates a sixth embodiment of a first reduction stage rotor configuration 530, for use in a mill in which it is useful to be able to vary the shear clearance between the rotor rings 524*a* and 524*b*. In this embodiment, the rings 524*a* and 524*b* are provided with both cut-outs 570 and bars 572 either closely or immediately adjacent the cut-outs 570, the inner and outer peripheral ring walls 580*a* and 580*b* are angled such that they form obtuse angles with the ring plates 550*a* and 550*b,* respectively, and the bar interior faces 572*a* are parallel to the ring inner peripheral walls 580*a,* such that the slope of any ring outer peripheral wall 580*b* is parallel with the slope of bar interior flees 572*b* on the opposed rotor. The angle formed by the inner and outer peripheral ring walls 580*a* and 580*b* and the ring plates 550*a* and 550*b,* respectively, is less than about 120°, since the angle of repose of the retained material is about 60°, as measured on the acute side of the angle.

Due to the angles of the facing surfaces of the bars 572 and the rings 524*a* and 524*b,* as one rotor is displaced axially relative to the other rotor, the shear clearance between rotor rings 524*a* and 524*b* varies. By raising or lowering either of the rotors, the shear clearance can be increased or decreased. In close-running clearance, the bars 572 and the adjacent cut-outs 570 can shear material against the edges of cut-outs 570.

Figure 8:
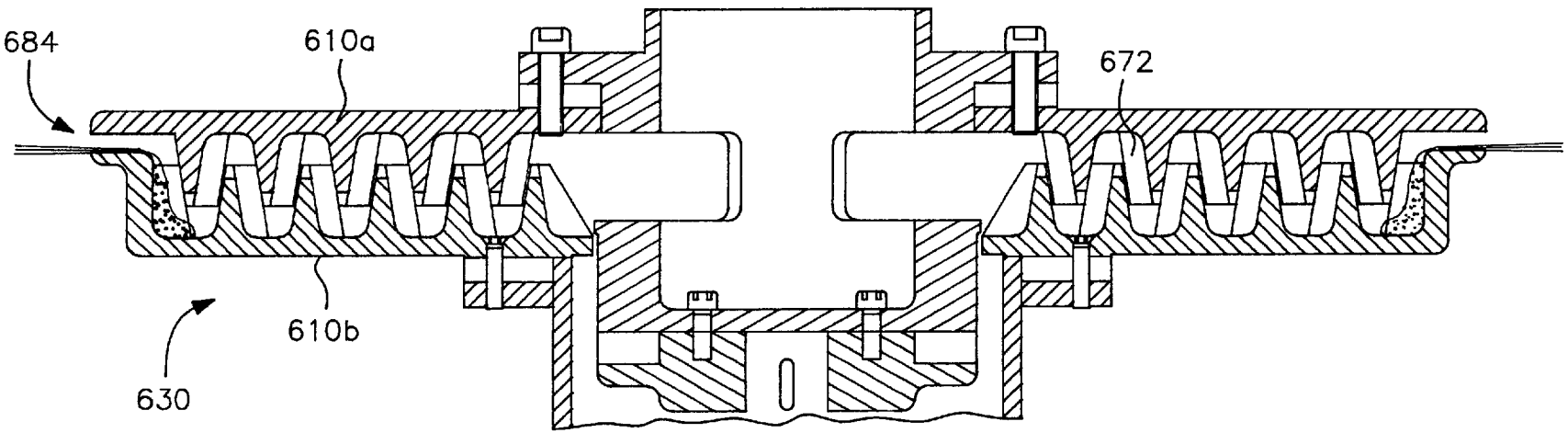
FIG. 8 is a cross-sectional view of a configuration similar to that shown in FIG. 7, but in a cast form and also showing the location of the second-stage means.

FIG. 8 shows a seventh embodiment of a first reduction stage rotor configuration 630, which is similar to the sixth embodiment shown in FIG. 7, but in the form of castings 610*a,* 610*b*, and to which bars 672 of hardened material have been affixed. A "top-size control ring set," or second-stage milling zone, can be provided radially outwardly of the upper and lower rotors of the first stage milling zone, at a position indicated by reference numeral 684, as discussed in greater detail below.

Figure 9A:
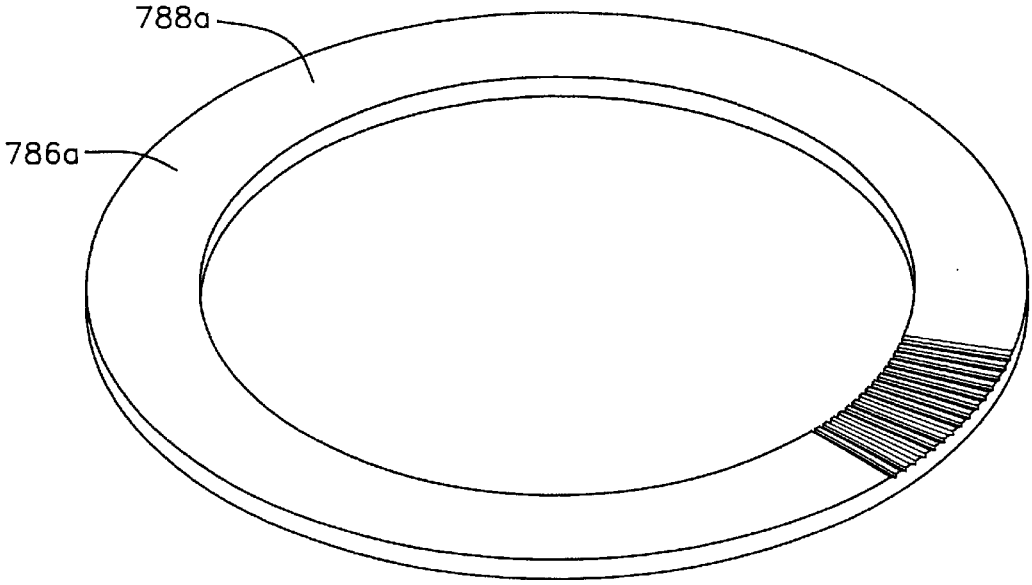
FIG. 9A is a perspective view of a first embodiment of a second-stage top-size control ring.
Figure 9B:
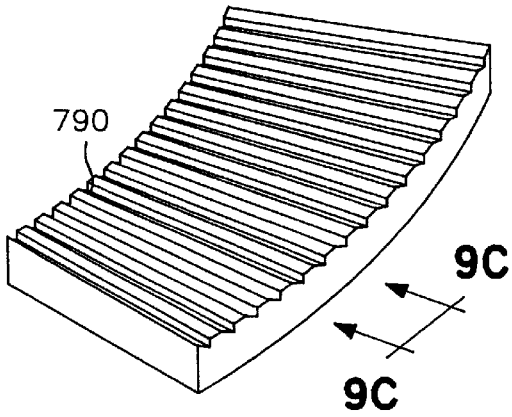
FIG. 9B is an enlarged view of the area designated by dashed lines in FIG. 9A.
Figure 9C:
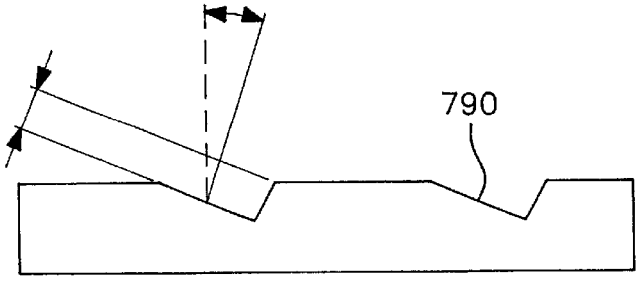
FIG. 9C is a cross-sectional view taken along line 9C—9C of FIG. 9B.

Referring now to FIGS. 9A, 9B, and 9C, there is shown a first embodiment of a second-stage crushing ring 786*a* that forms a part of a second-stage milling zone, and which can be installed in association with the lower rotor of FIG. 8. The crushing ring 786*a* has a planar upper face into which a plurality of spaced bevels or grooves 790 are incised. The bevels or grooves 790 can extend either radially or at an angle to radii of the ring. These bevels form acute angles relative to the planar upper surface, and have a feed depth of less than ⅛ inch.

A flat, hardened ring (not shown) is installed opposite on the upper rotor. Second-stage crushing of oversize particles occurs as particles and air are moved centrifugally and mechanically through the control ring set. Oversize particle reduction is accomplished as particles are caught in the sweep of the bevels on the ring.

Figure 10:
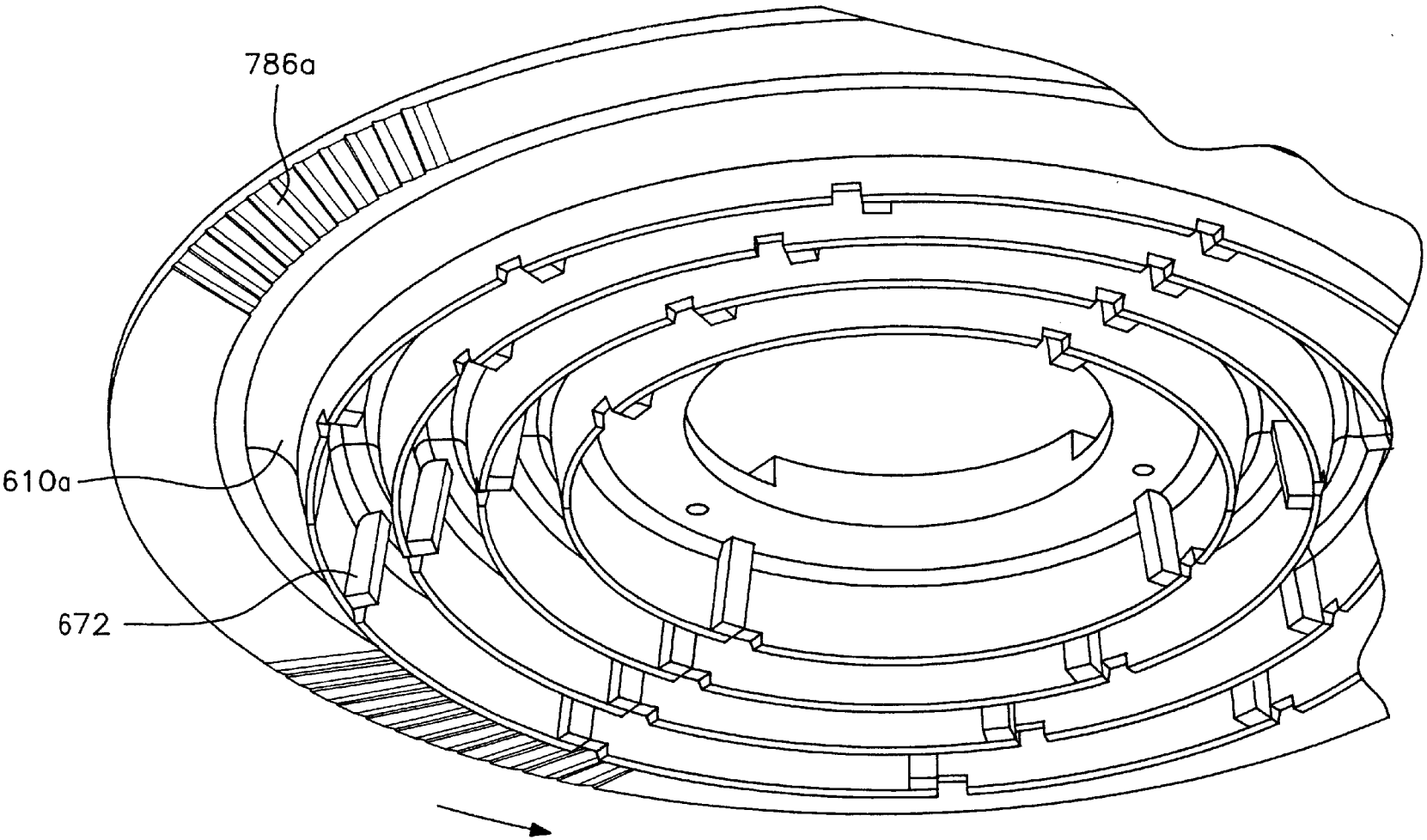
FIG. 10 is a perspective view showing the second-stage top-size control ring of FIG. 9A combined with a primary zone of the type shown in FIG. 8.

Referring now to FIG. 10, there is shown a second-stage crushing ring 786*a* identical to that shown in FIGS. 9A and 9B, installed in association with a cast upper rotor of the type shown in FIGS. 7 and 8.

Figure 11A:
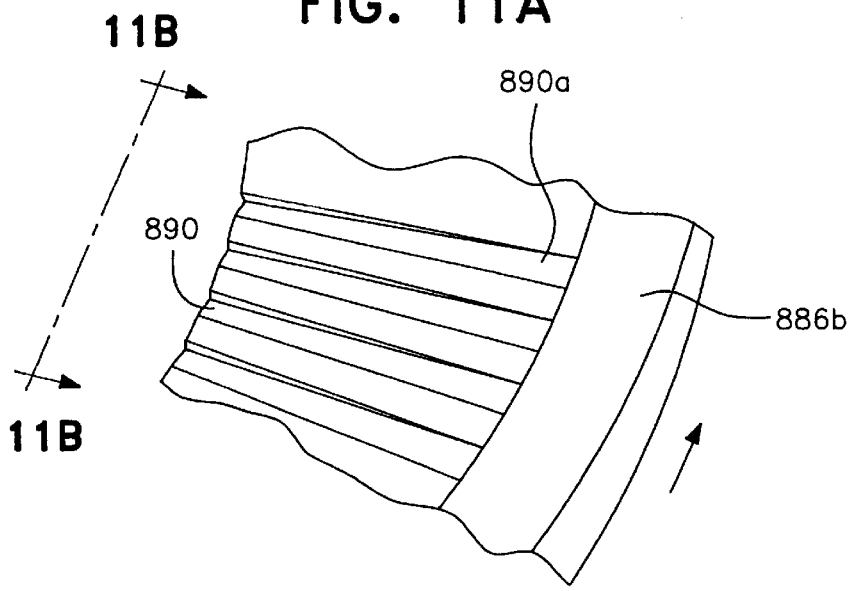
FIG. 11A shows a partial, perspective view of a second embodiment of the second-stage top-size control ring.
Figure 11B:
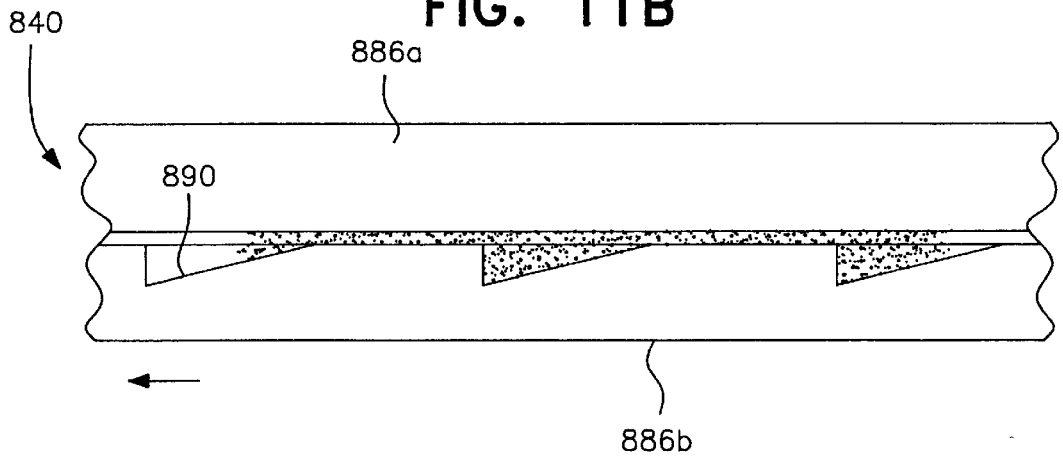
FIG. 11B is a cross-sectional view taken along line 11B—11B of FIG. 11A.

FIGS. 11A and 11B show a second embodiment of a second-stage milling zone 840. This embodiment includes an uninterrupted, planar upper ring 886*a* and an opposed planar crushing lower ring 886*b,* the surface of which is interrupted with radial or radially-angled bevels or grooves 890 that taper radially to a flat minimum clearance land. The uninterrupted upper ring 886*a* is mounted either independently of its associated rotor so as to be static, or dependently with its associated rotor so as to rotate therewith; whereas the interrupted lower ring 886*b* is mounted dependently with its associated rotor so as to rotate therewith, whereupon oversize particles are crushed between the land and an opposed, uninterrupted planar ring. Oversize particles and gases are moved centrifugally outward to the periphery of the ring set. In so doing particles move up the slope until they are crushed in the restricted gap which is sized to allow passage of only 100 mesh particles or smaller, in milling coal for suppressing nitrous oxides emissions in combustion. This embodiment differs from that shown in FIGS. 9 and 10 in that the radially-angled bevels or grooves 890 taper radially outwardly to a land 890*a,* and is preferred due to certainty it provides that only particles within specification will pass.

Figure 12:
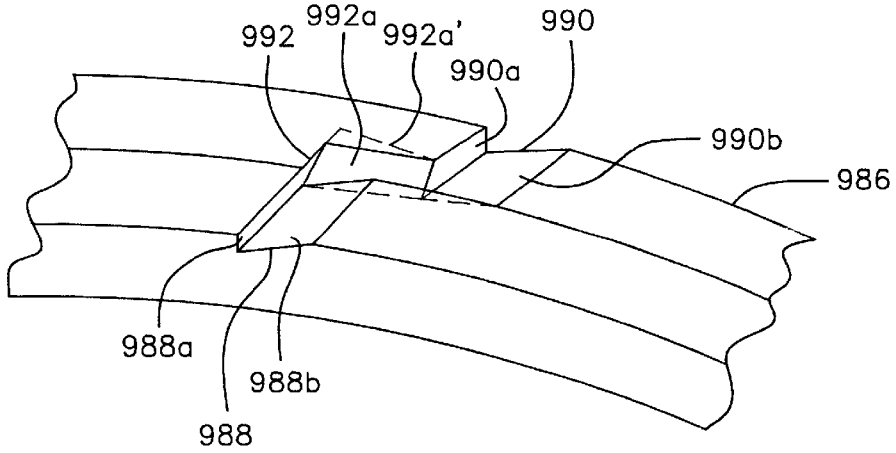
FIG. 12 is a partial perspective view of a third embodiment of the lower ring segment of the embodiment of second-stage top-size control ring.

FIG. 12 shows a third embodiment of a secondary milling zone ring 986. Manufacture of the lower secondary milling zone ring 986 is simplified by constructing it of two spaced annular sections, ring section A and ring section B. In this embodiment, the lower secondary milling ring 986 includes means for channeling flows of particles and gases such that particles are separated from gas-flow paths and impelled into a plurality of crushing zones. In particular, a plurality of equidistant or mass-balanced V-shaped cuts 988 are formed traversing the entire width of the ring section A and extending into a portion of the ring section B, one face 988*a* of the cuts 988 being either substantially perpendicular or acutely angled relative to the crushing surface and the other face 988*b* being angled relative to the crushing surface to define an inclined surface. The edges of the cuts 988 are substantially co-extensive with radii of the secondary milling ring.

A plurality of equidistant or mass-balanced cuts 990 are formed in the ring section B, each cut 990 being circumferentially offset from a respective cut A. One face 990*a* of the cuts 990 is either substantially perpendicular or acutely angled relative to the crushing surface, the other face 990*b* being angled relative to the crushing surface to define an inclined surface. The faces of the cuts 990 are formed at an angle either substantially radial to the secondary milling ring 986 or acutely angled relative to radii, with the outermost ends of the cuts 990 being away from the direction of rotation so that acute angled cuts 990 force more air draft, yet engage and crush lesser percentages of oversize particles, each feature being preferred where increased fan action and decreased fineness are desired.

A plurality of equidistant or mass-balanced cuts 992 are formed at the junction of ring sections A and B (that is, at the junction of the outer circumference of ring section A and the inner circumference of ring section B), joining cuts 988 and 990. Cuts 992 extend in an approximately circumferential orientation, one face 992*a* of the cuts 992 being angled relative to the crushing surface to define an inclined surface. The angle of face 992*a* can be varied as indicated at 992*a'* to force a sharper change of direction of the air flow.

Thus, each crushing zone comprises a plane on the surface of the rotor inclining toward a flat surface of the counter-rotating rotor so that oversize particles wedge between the flat and inclined surfaces and are crushed. The inclined surfaces occur in a plurality of grouped sequences of at least two inclined planes per sequence, with their inclines in alternating orientation, so that the first surface generally inclines chordally, and the second surface, located progressively outwardly beyond the radial location of the first inclined surface, generally faces the axis. Any third inclined surface—if applied—is located progressively outwardly beyond the radial location of the second inclined surface, generally facing chordally. All inclined surfaces are proximal to each other so that together they form a continuous and zig-zag channel to the outer periphery of the rotor device, the plurality of grouped sequences being spaced equidistantly around the rotor periphery.

Particles of process material are moved centrifugally out of the primary milling zone and into the cuts 988, where some move up the inclined surface of the cuts 988 until they are crushed within the close running clearance of the lower ring 986 and a flat surfaced counter-rotating upper ring in a manner similar to that previously described in connection with FIG. 11.

Other particles are crushed in a similar manner on or at the top of the surfaces of the cuts 992 and 990. As the movement of gases through and out of the rotating system must in large measure be completed by changes of direction at cuts 992 and then again at cuts 990, oversize particles are ejected from the gas flows at the direction changes and impelled by their masses up the surfaces of cuts 992 and 990 to be crushed.

The configuration of FIG. 12 provides high likelihood that all oversize particles will be reduced to specification, while also providing higher rates of air movement through the rotor set, thus improving particle to particle impact rates through turbulence within the primary reduction zone.

Figure 13A:
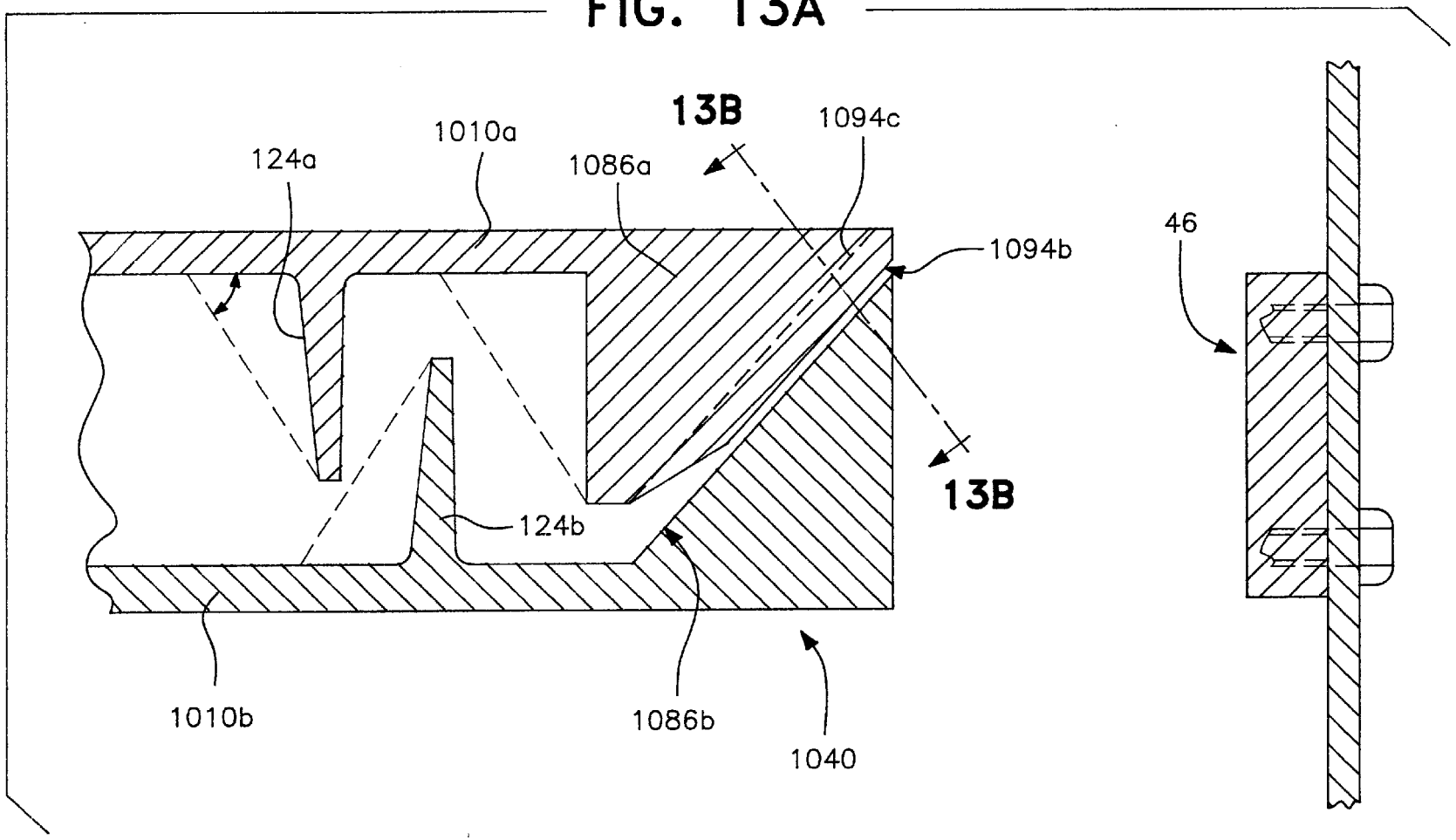
FIG. 13A is a partial cross-sectional view of a fourth embodiment of the lower ring segment of the embodiment of second-stage top-size control ring.
Figure 13B:
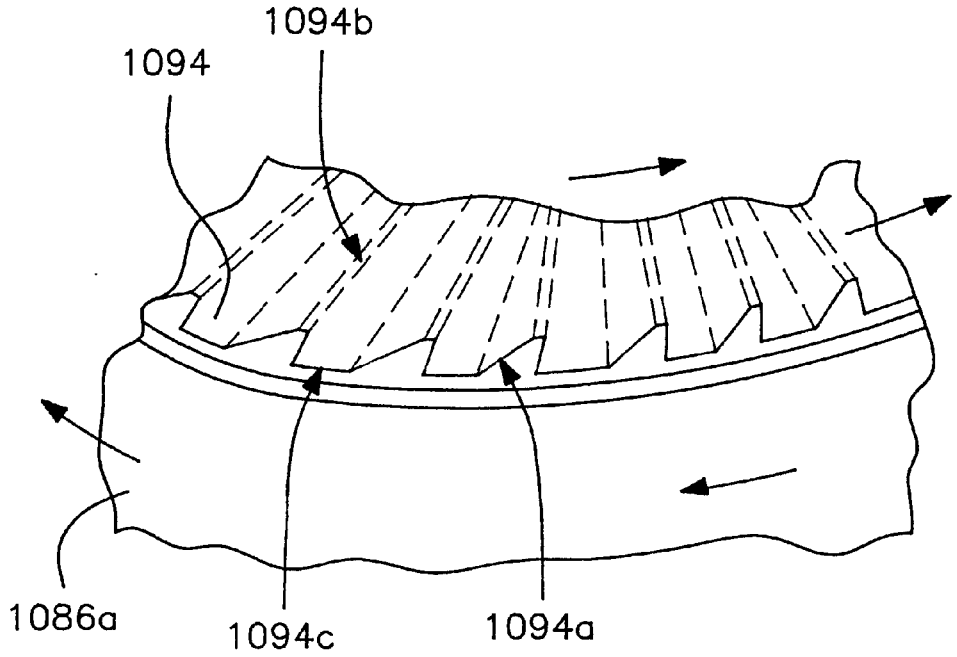
FIG. 13B is a partial perspective view of the lower surface of the upper milling ring of FIG. 13A.

Referring now to FIGS. 13A and 13B, there is shown a fourth embodiment of a second stage milling zone 1040, in which the upper surface of the lower ring 1086*b* is configured as an uninterrupted conical surface and the lower surface of the upper ring 1086*a* is configured as a conical surface interrupted by a plurality of spaced, radially-extending grooves 1094 defining grinding teeth. Each tooth comprises a crushing slope 1094*a* and a flattened apex 1094*b,* adjacent teeth being separated by planar lands 1094*c*. The upper and lower rotors can be provided with annular rings as disclosed in connection with FIGS. 2–7.

The upper and lower milling rings are integral with the upper and lower rotors, respectively, so as to rotate respectively with the upper and lower rotors. The uninterrupted conical surface of the lower ring 1086*b* resists radial centrifugal movement of particles emanating from the primary reduction zone. The amount of resistance is proportional to the angle of the conical surface; thus, the greater the slope of the conical surface, the greater the amount of resistance. Oversize particles are swept by centrifugal force into the grooves 1094 as the milling rings rotate relative to each other. Secondary crushing of oversize particles takes place between the multiple grinding teeth rotating in close clearance near the counter-rotating conical surface of the lower ring 1086*b*.

Figure 14B:
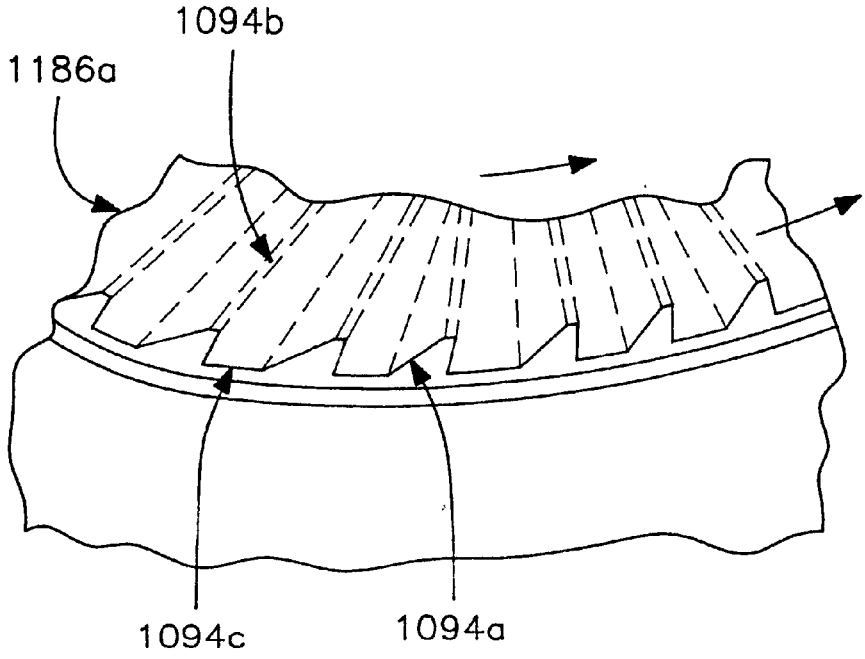
FIG. 14B is a partial perspective view of the lower surface of the upper milling ring of FIG. 14A.
Figure 14A:
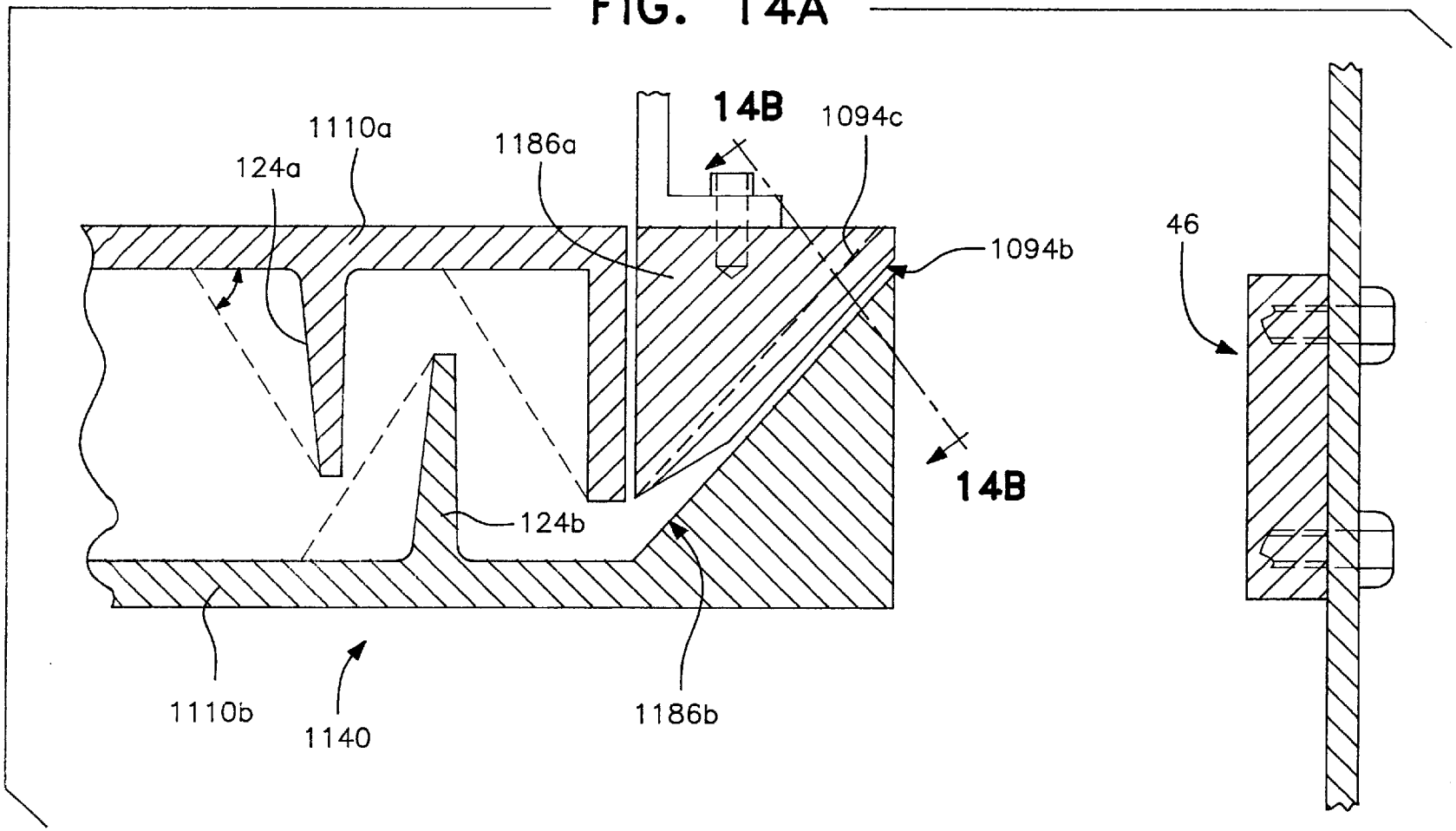
FIG. 14A is a cross-sectional illustration of a fifth embodiment of the lower ring segment of the embodiment of second-stage top-size control ring.

FIGS. 14A and 14B illustrate a fifth embodiment similar to the embodiment of FIGS. 13A and 13B, but in which upper milling ring 1186*a* is separate from the upper rotor 110*a*, and remains stationary while the upper rotor 1110*a*, the lower rotor 1110*b*, and the lower milling ring 1186*b* rotate.

Figure 15:
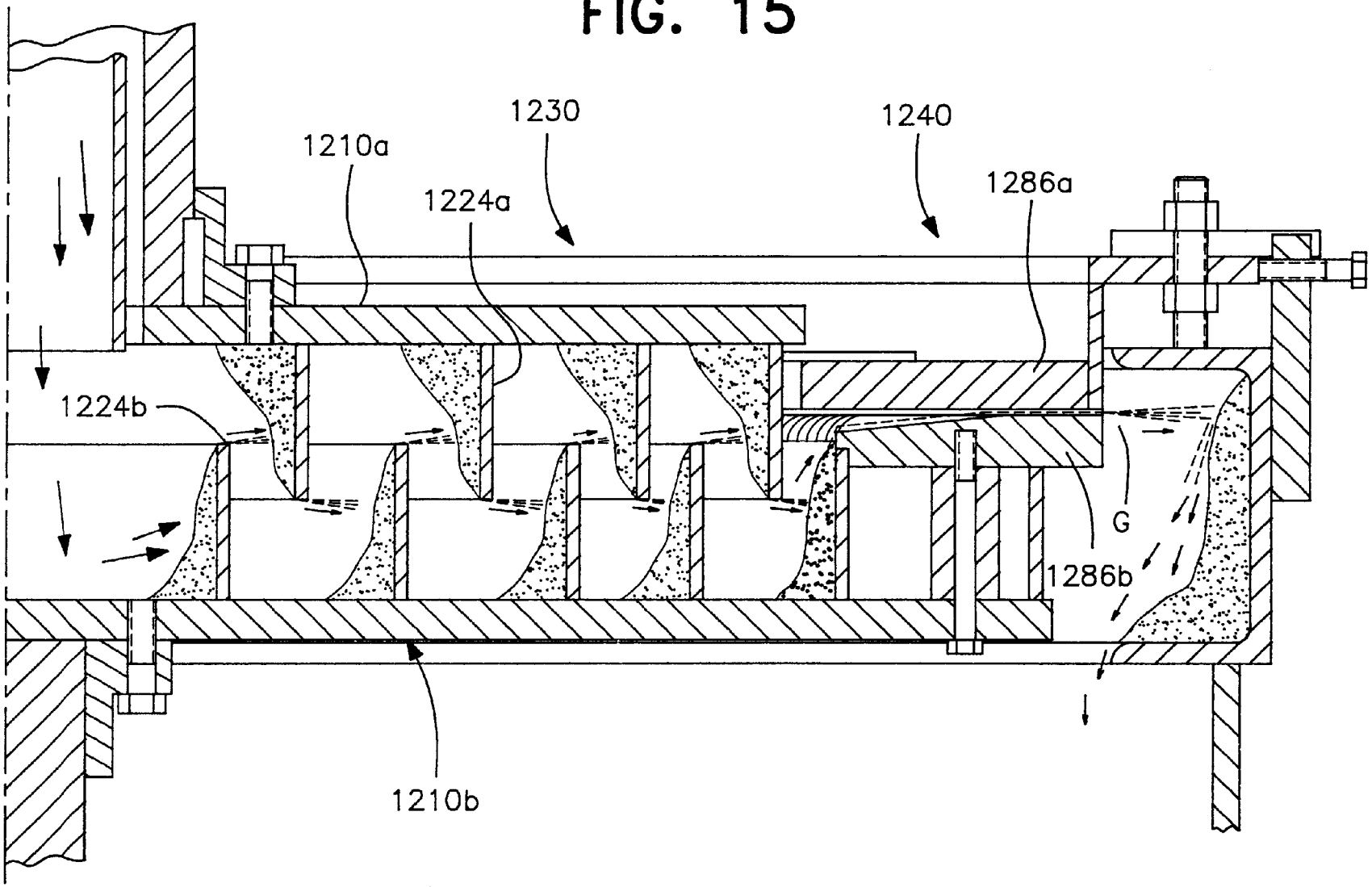
FIG. 15 is a cross-sectional view of an embodiment of a second-stage top-size control using a static upper ring.

Referring to FIG. 15, there is shown a sixth embodiment of the second stage milling zone 1240, in which the lower milling ring 1286*b* is integral with the lower rotor 1210*b* so as to be rotatable therewith and is configured as described in connection with FIGS. 9, 11A and 11B, or 12, and in which the upper rotor second-stage size control ring (i.e., the upper milling ring) 1286*a* is separate from the upper rotor 1210*a* and is uninterrupted and static. It will be appreciated by those of skill in the art that, alternatively, the lower milling ring 1286*b* can be separate from the lower rotor 1210*b*, while the upper rotor second-stage size control ring (i.e., the upper milling ring) 1286*a* is integral with the upper rotor 1210*a* so as to be rotatable therewith and is uninterrupted and static, as long as adequate air movement is provided. In another alternative, both the upper and the lower milling rings 1286*a* and 1286*b* can be integral with their respective rotors 1210*a* and 1210*b*, so as both to be rotatable counter to each other.

In the embodiment as shown in FIG. 15, the primary reduction zone 1230 comprises annular rings 1224*a* and 1224*b* which process material banks up, providing impact and abrasion action to reduce incoming material. The secondary milling zone 1240 crushes the oversize particles between the static upper ring 1286*a* and the rotating lower ring 1286*b*. No classification or recirculation is needed. The sized material passes through a preset gap G between the upper and lower control rings 1286*a* and 1286*b* at their outer edges, and exits to a collection bin (not shown).

Figure 16:
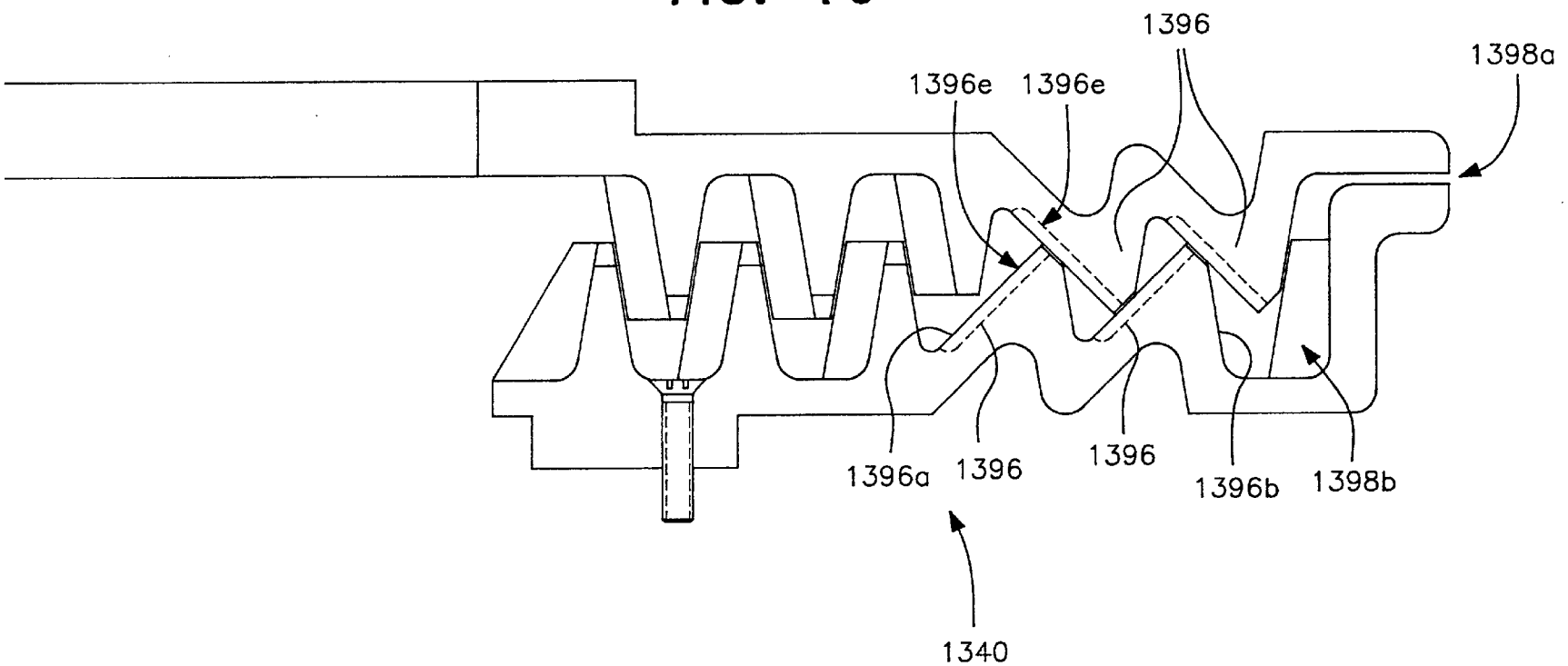
FIG. 16 is a cross-sectional view showing an embodiment of a second-stage top-size control ring for reducing wood-chip splinters or other elongated material.
Figure 17:
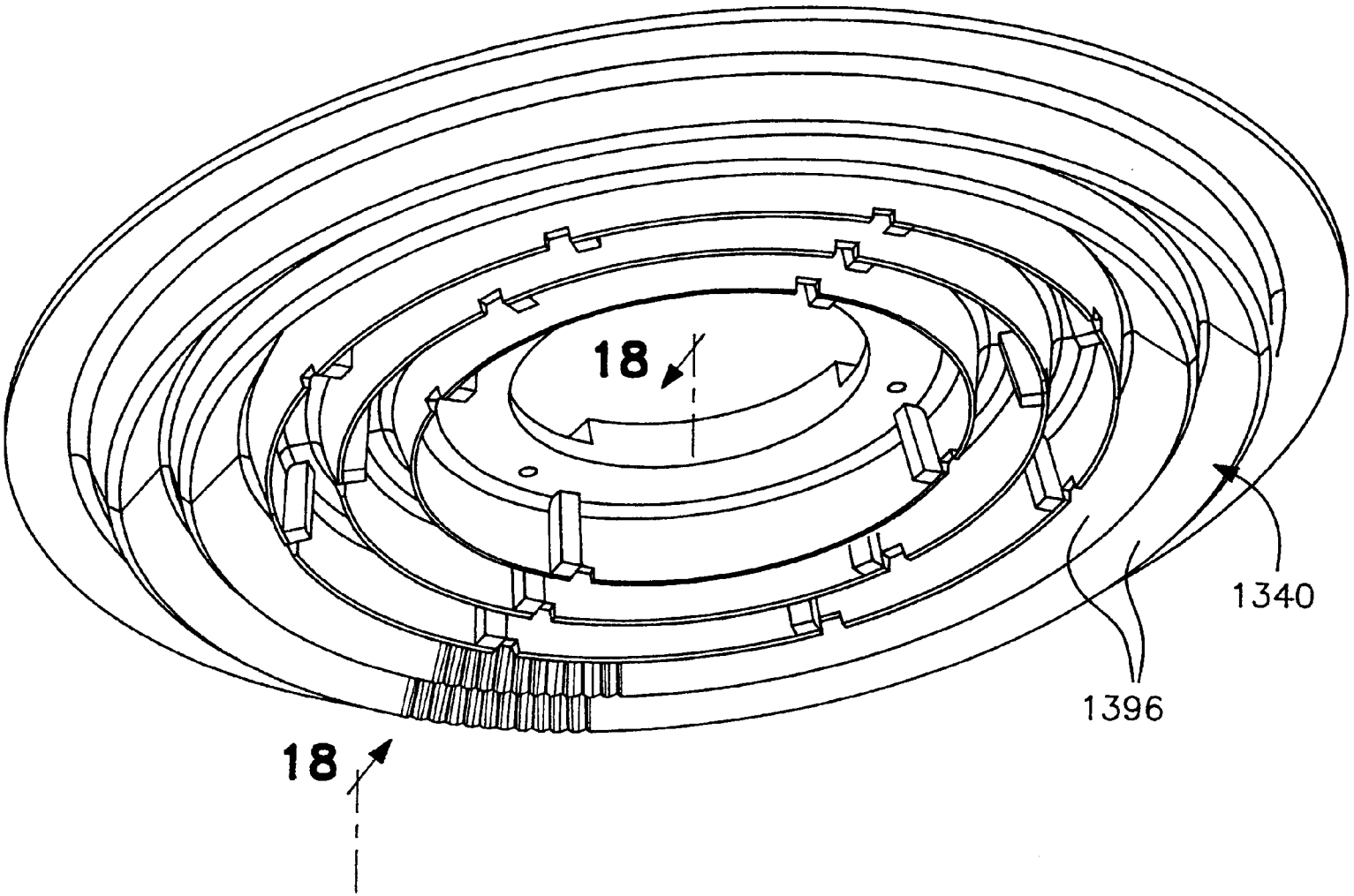
FIG. 17 is an inverted perspective view showing the upper rotor of FIG. 16.
Figure 18:
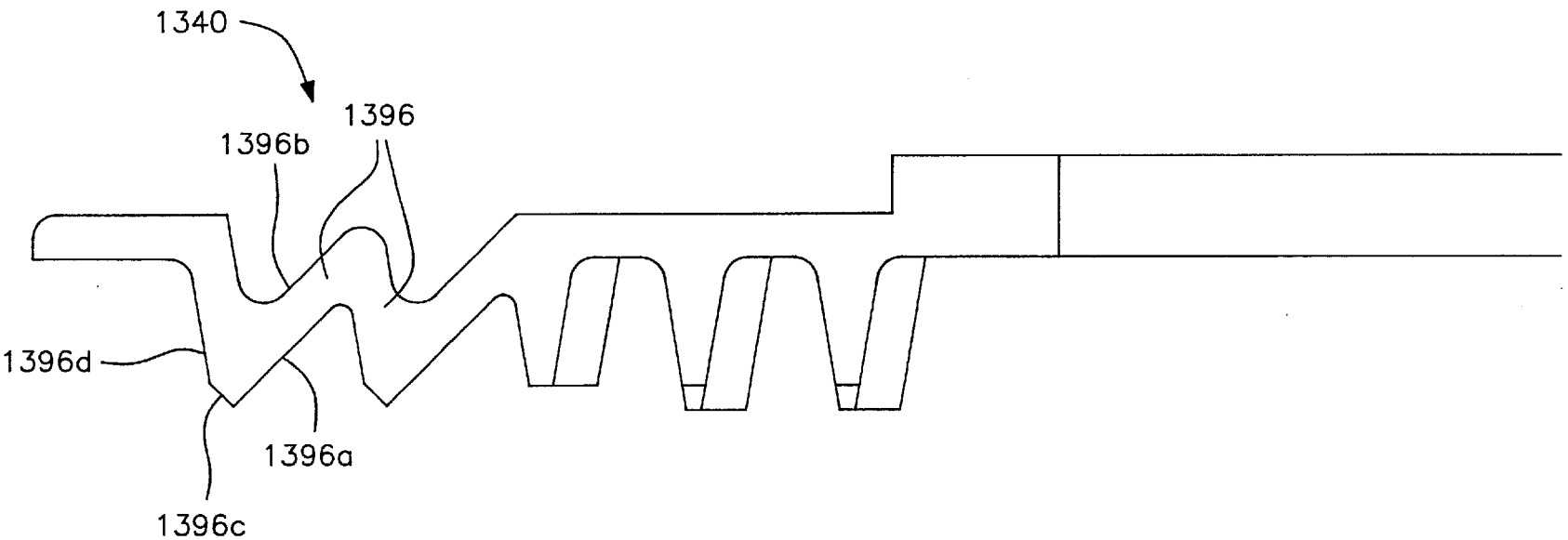
FIG. 18 is a cross-sectional view of the upper rotor, taken along line 18—18 of FIG. 17.

FIGS. 16–18 show a seventh embodiment in which the second stage 1340 includes at least one pair of opposing close-clearance rings 1396 configured for reducing oversize material, for example, for orienting and shearing long wood-chip splinters into shorter pieces. Each of the rings 1396 has an inner peripheral wall 1396*a* and an outer peripheral wall 1396*b*. Draft impeller ribs can optionally be placed at the locations designated at 1398*a* or 1398*b*.

As best shown in FIG. 18, in cross-section, the inner peripheral wall 1396*a* of each ring 1396 is sloped at an angle of about 45° to the vertical. The outer peripheral wall 1396*b* has a crown portion 1396*c* and a root portion 1396*d*, the crown portion 1396*c* in cross-section being perpendicular to the inner wall and sloping at an angle of about 45° to the vertical (so as to be complementary to the inner peripheral wall 1396*a* of the opposing ring) and the root portion 1396*d* in cross-section forming an angle of 100° with the horizontal. The inner wall has radially-extending ribs 1396*e* formed therein. In the rings 1396 that are configured to orient the wood-chip splinters, these ribs 1396*e* are denominated alignment ribs, and they are more closely spaced to orient the wood-chip splinters with their long dimensions in a radial direction for shearing. In the rings 1396 that are configured to shear the wood-chip splinters, these ribs 1396*e* are denominated shear ribs, and they are more widely spaced to permit passage of the splinters into the grooves for a given cut-off length. The wood-chip splinters are sheared by counter-rotation of the rings 1396. This embodiment is preferred for very fine final stage reduction of wood chips for use in boiler firing known as reburn, in which much finer fuel is combusted in the upper regions of furnaces.

Modifications and variations of the above-described embodiments of the present invention are possible, as appreciated by those skilled in the art in light of the above teachings. For example, as discussed above, although "upper" and "lower" are used herein to designate the relative positions of various elements of the invention, the configurations of these elements as described herein are applicable regardless of spatial orientation of the axis of rotation, sine centrifugal force acting through the proprietary elements of the rotating system yields equivalent size reduction effects regardless of location relative to gravitation. Vertical axis orientation permits more even loading on bearings and better retention of resident banked-up material, especially on start-ups and shut downs.

It is therefore to be understood that, within the scope of the appended claims and their equivalents, the invention may be practiced otherwise than as specifically described.

What is claimed is:

1. A rotary size reduction system, comprising:

a centrifugally acting primary size reduction zone having an inlet, the primary reduction zone being configured to achieve primary reduction of the pieces of material by attrition and impacting;

a center feed pipe having an outlet communicating with the inlet; and a secondary size reduction zone fed directly and centrifugally from the primary reduction zone, the secondary size reduction zone being configured to achieve secondary reduction of oversize pieces of material by a different type of mechanical action than the primary size reduction zone, wherein the secondary size reduction zone comprises a plurality of crushing zones and means for channeling flows of particles and gases such that particles are separated from gas-flow paths and impelled into the plurality of crushing zones.

2. The size reduction system as recited in claim 1, wherein the primary size reduction zone comprises:

first and second opposed rotors, the rotors having a plurality of concentric rings extending from their opposed surfaces, the rings of the first rotor interposing with the rings of the second rotor, the rotors being counter-rotatable at relatively high speed, whereby coarse material fed into the center of the rotor system through the center feed pipe is centrifugally thrown tangentially, progressively and outwardly from ring to ring on each of the counter rotating rotors, and is reduced in size through repeated high speed impacts and skidding abrasion associated with being so thrown.

3. A size reduction device as recited in claim 2, wherein the concentric rings are provided with a plurality of spaced peripheral cut-outs.

4. A size reduction device as recited in claim 3, wherein the spacing of the cut-outs is mass-balanced.

5. A size reduction device as recited in claim 3, wherein the cut-outs have a trailing edge which is downstream relative to the direction of rotor rotation, and the device further comprises bars affixed to the rings adjacent the trailing edge of each of the cut-outs, the bars extending substantially from the unmounted edges of the rings to the surfaces of the rotors.

6. A size reduction device as recited in claim 5, wherein the bars are near, but not abutting, the cut-outs.

7. A size reduction device as recited in claim 6, further comprising caps extending inwardly from the unmounted edge of the rings over the unmounted edges of the bars so as to crown the bars.

8. A size reduction device as recited in claim 5, wherein the bars are immediately adjacent the cut-outs.

9. A size reduction device as recited in claim 8, wherein the bars have a leading side face positioned at an angle relative to a normal to a tangent at the trailing edge of the cut-outs.

10. A size reduction device as recited in claim 9, wherein the leading side face of the bars is positioned at an angle of about 3° to about 30° relative to a normal to a tangent at the trailing edge of the cut-out.

11. A size reduction device as recited in claim 5, wherein the ring walls and the bars have an angled construction such that the slope of any outer ring wall is substantially parallel with the slope of the bars on the opposed rotor, whereby the clearance can be changed by moving either of the rotors along its axis of rotation.

12. A size reduction device as recited in claim 2, further comprising bars positioned at equidistant points around the peripheries of the rings, the bars extending both inwardly of the inner peripheries of the rings and outwardly of the unmounted facing edges of the rings.

13. A size reduction device as recited in claim 12, wherein radial clearances between the innermost and outermost edges of the equidistant bars are close clearances relative to successive particle sizes of material being processed for size reduction, such that the relative close clearances apply shearing or crushing forces to the particles.

14. A size reduction device as recited in claim 3, wherein the cut-outs are cut to a depth measured from the unmounted edges of the rings of between about ⅜ inch to about 1 inch in rings less than about 6 inches deep overall, or one-eighth to one-sixth of overall ring depth in larger rings.

15. A size reduction device as recited in claim 3, wherein the cut-outs are cut to a depth measured from the unmounted edges of the rings of between about one-eighth to one-sixth of overall ring depth.

16. A size reduction device as recited in claim 1, wherein the secondary reduction means comprises a pair of close clearance rings, one of the pair of rings being stationary.

17. A size reduction device as recited in claim 1, wherein the primary zone comprises between three and five sets of annular rings and the secondary zone comprises between one and two sets of annular rings.

18. A size reduction device as recited in claim 1, wherein each of the crushing zones comprises a plane on the surface of the rotor inclining toward a flat surface of the counter-rotating rotor, whereby oversize particles wedge between the flat and inclined surfaces and are crushed, the inclined surfaces occurring in a plurality of grouped sequences of at least two inclined planes per sequence with slopes positioned in alternating orientation, the first inclines surface generally facing chordally, and the second inclined surface being located progressively outwardly beyond the radial location of the first slope and generally facing the axis, all inclined surfaces being proximal to each other so that together they form a continuous and zig-zag channel to the outer periphery of the rotor device, the plurality of grouped sequences being spaced equidistantly around the rotor periphery.

19. A size reduction device as recited in claim 18, wherein each grouped sequence comprises a third inclined surface located progressively outwardly beyond the radial location of the second inclined surface and generally facing chordally.

* * * * *

UNITED STATES PATENT AND TRADEMARK OFFICE

CERTIFICATE OF CORRECTION

PATENT NO. : 6,286,771 B1
DATED : September 11, 2001
INVENTOR(S) : Charles Kepler Brown, Jr. et al.

It is certified that error appears in the above-identified patent and that said Letters Patent is hereby corrected as shown below:

Drawings,
Sheet 3, Figure 3:
In the ring 124b, the showing of feed material F should be deleted from the vertical bars 172b at the top and left of the illustration, as shown in the corrected drawing attached.

In the ring 124b, the vertical bar 172b at the bottom of the illustration:

a. The left-hand vertical dashed line should be moved to the right, as shown in the corrected drawing attached;
b. A dashed line should be added extending diagonally to the left showing the left side of the upper surface of the vertical bar 172b, as shown in the corrected drawing attached; and
c. The line corresponding to the outer edge of the horizontal cap 176 should be moved toward the line corresponding to the inner edge, as shown in the corrected drawing attached.

In the ring 124b, the vertical bar 172b at the left of the illustration, the dashed lines illustrating the non-visible edges of the horizontal cap 176 should be repositioned, as shown in the corrected drawing attached.

In the ring 124b, the vertical bar 172b at the right of the illustration, a dashed line illustrating the non-visible facing edge of the upper surface should be added, as shown in the corrected drawing attached.

In the ring 124b, the vertical bar 172 at the right of the illustration, a dashed line illustrating the non-visible right edge of the upper surface should be added, as shown in the corrected drawing attached.

UNITED STATES PATENT AND TRADEMARK OFFICE

CERTIFICATE OF CORRECTION

PATENT NO. : 6,286,771 B1 
DATED : September 11, 2001
INVENTOR(S) : Charles Kepler Brown, Jr. et al.

It is certified that error appears in the above-identified patent and that said Letters Patent is hereby corrected as shown below:

FIG. 3

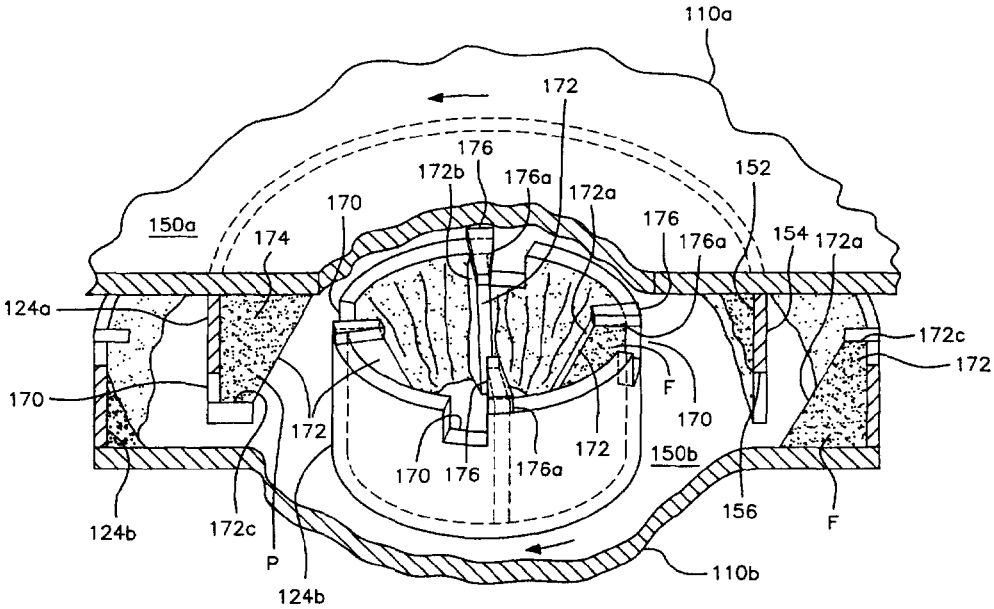

Signed and Sealed this

Sixth Day of August, 2002

*Attest:*

JAMES E. ROGAN

*Attesting Officer*

*Director of the United States Patent and Trademark Office*